US005433986A

United States Patent [19]

Moscatello

[11] Patent Number: 5,433,986

[45] Date of Patent: Jul. 18, 1995

[54] COMBINATION SLUTTER AND NOSING STRIP

[76] Inventor: David Moscatello, 31397 Edgewood, Warren, Mich. 48093

[21] Appl. No.: 195,329

[22] Filed: Feb. 14, 1994

[51] Int. Cl.[6] ..... B32B 3/02; B32B 3/10

[52] U.S. Cl. ..... 428/120; 428/131; 428/192; 52/179; 52/254; 52/255

[58] Field of Search ..... 428/120, 192; 52/179, 52/254, 255

[56] References Cited

U.S. PATENT DOCUMENTS

| | | | |
|---|---|---|---|
| D. 117,686 | 11/1939 | Bonnell | 428/31 |
| 2,483,888 | 10/1949 | Danielson | 72/0.5 |
| 2,881,485 | 4/1959 | Hyman | 20/79 |
| 3,287,867 | 11/1966 | Aton | 52/179 |
| 3,524,291 | 8/1970 | Rozanski | 52/169 |
| 4,285,177 | 8/1981 | Seegers | 52/179 |
| 4,321,294 | 3/1982 | Naka | 428/61 |
| 4,625,266 | 11/1986 | Winter | 362/146 |
| 5,073,430 | 12/1991 | Aidan | 428/43 |
| 5,144,778 | 9/1992 | Pourtau et al. | 52/254 |

*Primary Examiner*—Alexander S. Thomas
*Attorney, Agent, or Firm*—Harness, Dickey & Pierce

[57] ABSTRACT

A combination slutter and nosing strip for covering the outwardly facing unfinished edges of tiles and a stair tread on which the tiles are mounted. The combination slutter and nosing strip includes, a horizontal anchoring flange secured between the stair tread and the tiles. The combination slutter and nosing strip further includes an upwardly extending slutter bar segment for covering the outwardly facing unfinished edge of the tiles and a downwardly projecting nosing segment for covering the exposed unfinished edge of the stair tread.

4 Claims, 1 Drawing Sheet

COMBINATION SLUTTER AND NOSING STRIP

BACKGROUND OF THE INVENTION

The present invention relates generally to trim strips for tiled surfaces and, more particularly, to a combination slutter and nosing strip for use with tiled stairs and the like.

In typical residential and commercial tile installations, the tiles are laid on a rigid sub-platform (i.e., a floor surface, walls, etc.) on which a layer of a suitable mastic adhesive or tile cement has been pulled. After the tiles have set (i.e., adhesively bonded to the sub-platform), a suitable grouting material is pushed into the gaps established between adjacent tiles to maintain spaced alignment and complete the installation process. However, at the peripheral edges of the installation area, the exposed tile edges are typically not of a suitable finish quality such that installation of an additional trim strip or the like is commonly required. For example, a slutter strip may be used to separate a tiled floor section from an adjacent floor section having a different floor covering (i.e., wood planking, tile, carpet, etc.) for establishing a decorative delineation therebetween While covering the exposed tile edges. Conventional slutter strips typically include an elongated anchoring flange segment that is secured to the sub-platform. The tiles are then placed on the anchoring flange segment such that the exposed unfinished edges thereof abut a vertical flange segment of the slutter strip.

When tiles are installed on stairs, the stair tread functions as the sub-platform for the tiles such that the outermost peripheral edge of the stair tread is also left exposed. Unfortunately, the exposed edges of the tile and the stair tread itself are generally considered unsightly such that an additional finishing step is routinely required for presenting a more acceptable aesthetic appearance at the stair edge. For example, tiles having a rounded edge, commonly referred to as bullnose tiles, may be laid so as to cover the edge of the stair tread for providing a finished tiled edge. However, bullnose tiles are typically expensive and have specific uses which limit their versatility, thereby increasing both the material and labor costs associated with their installation. Alternatively, tiles may be mounted to the vertical stair riser such that the exposed edge of the stair tread may be covered. This alternative generally requires overlapping of a vertical tile covering the stair riser with a horizontal tile extending over the edge of the stair tread. However, because a portion of the horizontal tile overhangs the stair tread, it is readily susceptible to undesirable cracking from the weight normally borne by the stair thread. In addition, such a tile alternative is not practical in those situations where the: stair tread overhangs the stair riser, a construction referred to as a stair "nosing".

As an alternative to the above-noted tiled stair edges, a trim member may be installed onto the tread edge So that it covers the exposed edge of the tiles. Examples of such trim strips for use with tiled stairs are disclosed in U.S. Pat. Nos. 5,073,430 (Aidan), and 5,144,778 (Pourtau et al.). Similarly, the trim strip shown in U.S. Pat. No. 4,625,266 (Winter) is adapted to cover both the exposed tile edge and the exposed edge of the stair tread. According to yet another alternative, U.S. Pat. No. 3,287,867 (Aton) discloses a stair trim component having a slutter bar segment and a stair nosing segment. However, an elongated slot must be routered into the exposed edge of the stair tread to facilitate installation of the anchoring flange segment of this stair trim component. Such an installation requirement is not only time consuming but also requires a high degree of precision since misalignment of the routered slot relative to the final exterior tiled floor surface may result in an undesirable raised lip being created.

Thus, a need exists in the tile industry for a stair trim component which overcomes the numerous functional and installation-related shortcomings associated with conventional trim strips.

SUMMARY OF THE INVENTION

In view of the above, the present invention is primarily directed to providing an improved trim component for covering the exposed unfinished edges of both the tiles and an associated sub-platform on which the tiles are laid.

According to a preferred embodiment, the trim component of the present invention is a combination slutter and nosing strip which includes A) an anchoring flange segment that is placed between the tile and the sub-platform for anchorage in the tile cement, B) a slutter bar segment which extends upwardly from the anchoring flange segment to cover the exposed edge of the tiles, and C) a nosing segment which extends downwardly from the anchoring flange segment to cover the exposed edge of the sub-platform. Thus, the trim component of the present invention may be installed quickly and easily with a minimum of installation steps and materials required.

From the subsequent detailed description taken in conjunction with the accompanying drawings and subjoined claims, other objects and advantages of the present invention will become apparent to those skilled in the art.

DETAILED DESCRIPTION OF THE DRAWINGS

Figure 1:
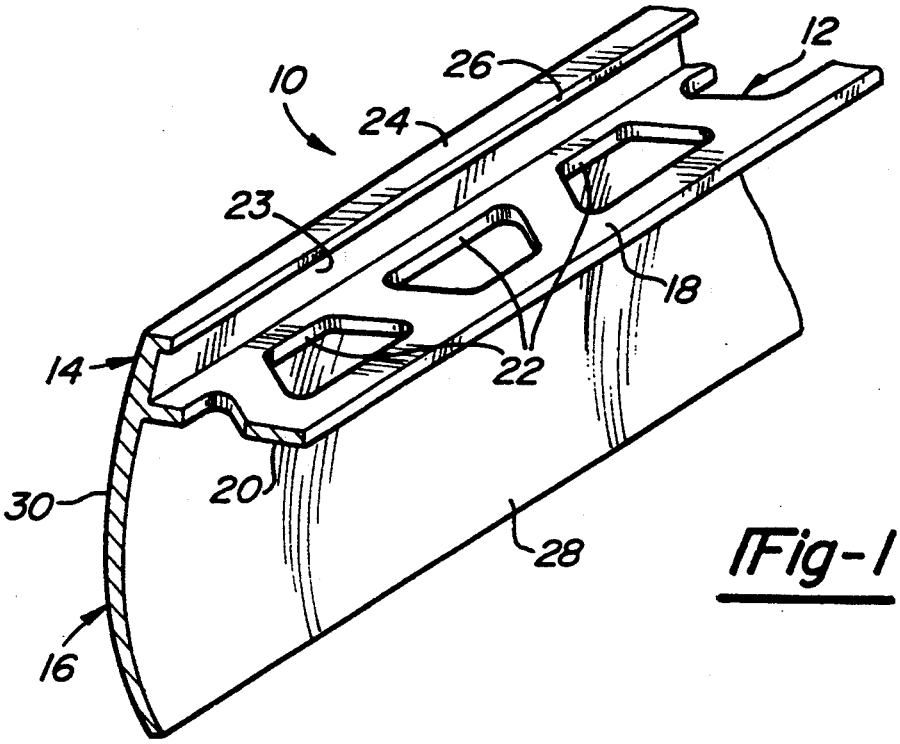
FIG. 1 is a partial perspective view of a combination slutter and nosing strip in accordance with a preferred embodiment of the present invention.

Referring to the drawings, a combination slutter and nosing strip 10 according to a preferred embodiment of the present invention is shown. As best seen from FIG. 1, combination slutter and nosing strip 10 includes a horizontal anchoring flange 12, a slutter bar segment 14 extending upwardly from anchoring flange 12, and a nosing segment 16 extending downwardly from anchoring flange 12. As will be detailed, anchoring flange 12 is adapted for installation between a sub-platform structure and one or more tiles laid on the sub-platform. In addition, slutter bar segment 14 is adapted to cover the exposed edge of the tile while nosing segment 16 is adapted to cover the exposed edge of the sub-platform floor structure.

According to the preferred embodiment shown in the drawings, anchoring flange 12 is generally orthogonally aligned relative to slutter bar segment 14 and nosing segment 16, and includes an upper planar surface 18, a lower planar surface 20 and a series of apertures 22 formed threbetween which enable tile cement to pass therethrough for adhesively securing anchoring flange 12 to the sub-platform. Slutter bar segment 14 is shown to include an inner wall 23 which faces the tiles when combination slutter and nosing strip 10 is installed, and an inwardly extending lip 24 having an edge 26 that is adapted to contact, or be located in close proximity to, the exposed edge of the tiles. Moreover, the height of slutter bar segment 14 relative to upper surface 18 of anchoring flange 12 is selected to cover the entire exposed edge of the tiles positioned adjacent thereto with lip 24 providing a finished delineating boundary with respect thereto. While shown to be generally orthogonally aligned relative to anchoring flange 12, slutter bar segment 14 may also be formed at an acute angle thereto, and lip 24 may alternatively be generally rounded or contoured to provide various aesthetically-pleasing alternatives of combination slutter and nosing strip 10 from which the user can select. To accommodate tiles of different thicknesses, combination slutter and nosing strip 10 is also contemplated to be provided in a series of differently sized trim components wherein the height of slutter bar segment 20 can be selected from a range of sizes for use with tiles of different thicknesses.

Nosing segment 16 includes an inner surface 28 which may, but need not, contact the edge surface of the sub-platform on which combination slutter and nosing strip 10 is installed. It is again contemplated that the length of nosing segment 16 relative to lower surface 20 of anchorage flange 12 can be provided in a series of sizes to accommodate different tile installation applications. Additionally, combination slutter and nosing strip 10 includes an exterior surface 30. Exterior surface 30 preferably provides a common decorative exterior surface for combination slutter and nosing strip 10 and may be formed in a number of various shapes in accordance with the particular decorative choices made by the designer.

Figure 2:
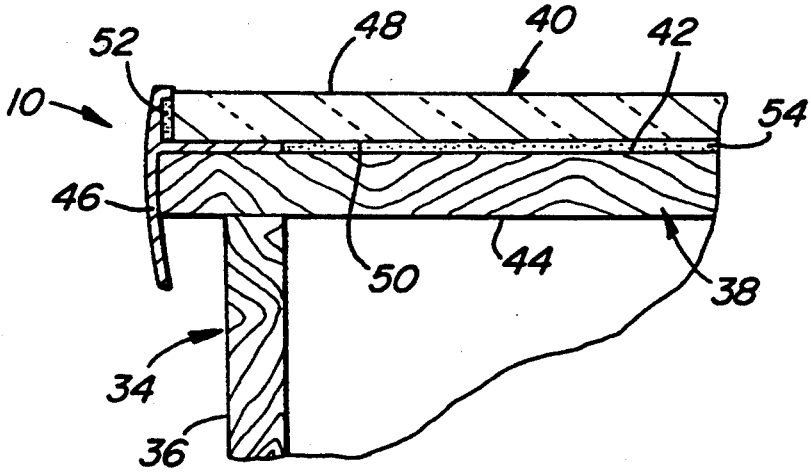
FIG. 2 is a cross-sectional view of the combination slutter and nosing strip installed on a tiled stair step.

With particular reference now to FIG. 2, combination slutter and nosing strip 10 is shown installed onto a stair 32 including a vertical riser 34 having an outer surface 36, and a horizontal stair tread 38 which functions as the sub-platform structure on which one or more tiles 40 are mounted. Stair tread 38 includes an upper surface 42, a lower surface 44, and an exposed edge 46 therebetween. Likewise, each tile; 40 has an upper surface 48, a lower surface 50, and an exposed tile edge 52.

Each tile square 40 is laid on stair tread 38 using any of a number of traditional tile application processes known in the art. As shown, a layer of a suitable tile mastic or cement material 54 is first applied to top surface 42 of stair tread 38, and combination slutter and nosing strip 10 is then placed along exposed edge 46 of stair tread 38 such that anchorage flange lower surface 20 rests on top of stair tread surface 42 and/or a fine layer of the tile cement 54. Preferably, the layer of tile cement 54 passes through apertures 22 for keying or adhesively securing anchoring flange 12 and, in turn, combination slutter and nosing strip 10 to stair tread 38. More preferably, the layer of tile cement 54 should be greater than the thickness of anchoring flange 12 so as to also provide a thin layer covering top surface 18 of flange 12 for supporting and adhesively securing tiles 40 laid thereon.

Upon installation of tiles 40 onto anchoring flange 12, the outward unfinished edge 52 of each tile 40 is preferably aligned to engage inwardly facing edge 26 of lip 24 on slutter segment 14, but need not necessarily as grouting material may fill any small gap therebetween. Moreover, such alignment of the outward facing edge 52 of tiles 40 relative to inwardly facing edge 26 of slutter bar segment 14 leaves a slight gap between inner wall 23 of combination slutter and nosing strip 10 and the outward facing edge 52 of tiles 40. Alternatively, tile 40 may be cut so that its outward facing edge 52 contacts inner wall 23 of slutter segment 20. As shown in FIG. 2, outward facing edge 46 of stair tread 38 contacts the inward facing surface 28 of nose segment 16. However, it should be noted that these edges need not necessarily contact each other, and such contact depends on the particular design of combination slutter and nosing strip 10. Likewise, the length of nose segment 16 may be selected so as not to overhang lower surface 44 of stair riser 34 if so desired.

In application, it can be seen that combination slutter and nosing strip 10 provides a convenient mechanism for decoratively covering the normally exposed unfinished edges of stair tread 38 and tiles 40. Moreover, combination slutter and nosing strip 10 may be installed quite easily as part of the otherwise conventional tile installation process.

While the above detailed description describes a preferred embodiment of the present invention, it will be understood that the present invention is susceptible to modification, variation and alteration without deviating from the scope and fair meaning of the subjoined claims.

What is claimed is:

1. A trim strip in combination with a tile and stair or step for covering an outwardly facing edge of both the tile and associated horizontal stair tread, the stair tread having an upper surface on which the tile is laid, the combination comprising:

a horizontal anchoring flange including an upper surface and a lower surface, said horizontal anchoring flange adapted to be disposed between the tile and the stair tread;

a slutter bar segment extending from said anchoring flange and having an inwardly projecting lip displaced from said horizontal anchoring flange, said slutter bar segment adapted to cover the outwardly facing edge of the tile; and a nosing segment having an outer surface and an inner surface, said nosing segment extending from said anchoring flange adapted for covering the outwardly facing edge of the stair tread;

whereby said lower surface of said anchoring flange and at least a portion of said inner surface of said nosing segment cooperate to define an inner corner adapted to substantially mate with adjacent portions of the upper surface and outwardly facing edge of the stair tread.

2. The combination as defined in claim 1 further comprising exterior surface means integrally combining an outwardly facing surface of said slutter bar segment and an outwardly facing surface of said nosing segment for providing a common outwardly facing exterior decorative surface on the trim strip.

3. The combination as defined in claim 2 wherein said horizontal anchoring flange includes apertures through which a layer of an adhesive tile cement may pass in order to provide means for adhesively securing said trim strip to the stair tread.

4. A combination slutter bar and nosing strip for use on a stair or step for covering the outwardly facing edges of a tile and an associated horizontal stair tread, the stair tread having an upper surface on which the tile is laid, the combination slutter bar and nosing strip comprising:

a horizontal anchoring flange including an upper surface and a lower surface, said horizontal anchoring flange adapted :to be disposed between the tile and the stair tread;

a unitarily formed ornamental segment, said ornamental segment being attached to said anchoring flange and including a slutter bar portion and a nosing strip portion, said nosing strip portion having an outer surface and an inner surface, said slutter bar portion upwardly extending from said anchoring flange and having an inwardly projecting lip displaced from said horizontal anchoring flange, said slutter bar portion adapted to cover the outwardly facing edge of the tile, said nosing strip portion downwardly extending from said anchoring flange and adapted to cover the outwardly facing edge of the stair tread, said nosing strip portion further adapted to be disposed substantially adjacent to the outwardly facing edge of said stair tread, said ornamental portion having a generally uniform thickness;

whereby said lower surface of said anchoring flange and at least a portion of said inner surface of said nosing strip portion cooperate to define an inner corner adapted to substantially mate with adjacent portions of the upper surface and outwardly facing edge of the stair tread.

* * * * *